US005282276A

United States Patent [19]

Preziose

[11] Patent Number: 5,282,276

[45] Date of Patent: Feb. 1, 1994

[54] FINGERNAIL PROTECTOR

[76] Inventor: Marlene Preziose, P.O. Box 43, Throggs Neck Station, N.Y. 10465

[21] Appl. No.: 914,497

[22] Filed: Jul. 15, 1992

Related U.S. Application Data

[63] Continuation of Ser. No. 691,709, Apr. 26, 1991, abandoned.

[51] Int. Cl.[5] ..... A45D 29/00

[52] U.S. Cl. ..... 2/21; 132/73

[58] Field of Search ..... 2/21, 163, 16, 160; 132/73, 285, 73.5, 76.2; 16/227; 63/15, 15.8, DIG. 3

[56] References Cited

U.S. PATENT DOCUMENTS

| | | | |
|---|---|---|---|
| 203,978 | 5/1878 | Woods | 2/21 |
| 2,179,046 | 11/1939 | Lewis | 132/73 |
| 2,251,551 | 8/1941 | O'Reilly | 2/21 |
| 2,287,062 | 6/1942 | Powers et al. | 132/285 |
| 2,487,101 | 11/1949 | Colby et al. | 2/21 |
| 2,546,619 | 3/1951 | Turner | 2/21 |
| 2,557,759 | 6/1951 | Pfister | 2/21 |
| 4,089,066 | 5/1978 | Dethman | 2/21 |
| 4,158,902 | 6/1979 | Chernack et al. | 16/227 |
| 4,615,462 | 10/1986 | Sacherer et al. | 16/227 |
| 4,966,174 | 10/1990 | Stanczak | 2/21 |
| 4,984,592 | 1/1991 | Hellein | 2/21 |

FOREIGN PATENT DOCUMENTS

| | | | |
|---|---|---|---|
| 3321000 | 12/1984 | Fed. Rep. of Germany | 16/227 |

*Primary Examiner*—Clifford D. Crowder
*Assistant Examiner*—Amy B. Vanatta
*Attorney, Agent, or Firm*—R. Neil Sudol; Henry D. Coleman

[57] ABSTRACT

A fingernail protector comprises a fingernail shield, an attachment device or fastener for temporarily securing the protector to a user's finger, and a connector or coupling portion for pivotably connecting the shield to the fastener so that the shield is disposed distally of the fastener in a use position of the shield and so that the shield is swingable about an axis oriented substantially transversely to the user's finger. The connector includes a toggle hinge which enables the shield to be pivotably connected to the attachment device or fastener so that the shield is swingable between a first stable toggle position and a second stable toggle position. The fingernail protector is an integral piece formed by injection molding.

4 Claims, 1 Drawing Sheet

FINGERNAIL PROTECTOR

This application is a continuation of application Ser. No. 691,709, filed Apr. 26, 1991, now abandoned.

BACKGROUND OF THE INVENTION

This invention relates to a fingernail protector device.

Devices for protecting a fingernail during the drying of a coating of fingernail polish or enamel are well known. U.S. Pat. No. 2,487,101 to Colby et al. discloses a fingernail protector in which a shield part is pivotably connected to a finger gripping part via intertwined or interleaved coils, whereby the shield is rotatably about an axis extending parallel to the finger.

U.S. Pat. No. 4,089,066 to Dethman shows and describes a fingernail protector having a ring for attaching the device to a user,s finger, a semi-cylindrical lower cover connected to the ring, and a semi-cylindrical upper cover pivotably connected to the lower cover for rotation about an axis extending parallel to the finger.

U.S. Pat. No. 2,557,759 to Pfister is directed to a finger polish guard comprising a tubular member with a fingernail-shaped opening to expose the nail, a ring member for fixing the finger in position relative to the opening, and curved closure or cover for masking the nail.

In the afore-described fingernail protection devices, it appears that the shield part can close inadvertantly, for example, upon a movement of the finger. Such accidental closing of the shield is undesirable if the user is applying a coating of enamel to the finger. The unintended shield closing can cause the brush or applicator to leave a mark or an undesirable amount of enamel on the nail.

Another disadvantage of the above-described fingernail protectors is their complexity. The complexity results in an elevated production cost. It would be advantageous for an item to be manufacturable as efficiently and as inexpensively as possible.

Yet another disadvantage of at least some of the abovedescribed fingernail protectors is the likelihood of their interference with portions of the user's hand other than the finger to which the particular protector is attached.

OBJECTS OF THE INVENTION

An object of the present invention is to provide a fingernail protector which is easy and inexpensive to manufacture.

Another object of the present invention is to provide a fingernail protector which does not close accidentally.

Another, more particular, object of the present invention is to provide such a fingernail protector with a fingernail shield which locks in a removed or opened position.

A further particular object of the present invention is to provide a simple fingernail protector which minimized interference with other parts of the user,s hand during use.

SUMMARY OF THE INVENTION

A fingernail protector comprises, in accordance with the present invention, a fingernail shield, an attachment device or fastener for temporarily securing the protector to a user's finger, and a connector or coupling portion for pivotably connecting the shield to the fastener so that the shield is disposed distally of the fastener in a use position of the shield and so that the shield is swingable about an axis oriented substantially transversely to the user's finger.

Pursuant to another feature of the present invention, the shield has a substantially planar body portion and a skirt integral with the body portion along three edges thereof. The shield is pivotably coupled by the connector to the fastener along a fourth edge of the shield's body portion.

Pursuant to further features of the present invention, the shield is provided with a plurality of apertures in the body portion and the connector includes a toggle hinge. The toggle hinge enables the shield to be pivotably connected to the attachment device or fastener so that the shield is swingable between a first stable toggle position and a second stable toggle position.

Pursuant to a more specific feature of the present invention, the toggle hinge includes a fold-line hinge part and at least one resilient spring part.

In an alternative conceptualization of the invention, a fingernail protection device comprises (a) a fingernail shield, (b) an attachment portion or fastener for temporarily securing the protector to a user's finger, (c) a connector or coupler for pivotably connecting the shield to the fastener so that the shield is swingable between a fingernail covering position and a shield removed position and a locking component for enabling a locking of the shield in the removed position.

Pursuant to another feature of the present invention, the locking component enables a locking of the shield in the fingernail covering position of the shield.

Specifically, the connector or coupler includes a foldline hinge, while the locking component includes a spring element.

Pursuant to additional features of the present invention, the fastener includes a slotted ring, while the shield, the fastener and the connector are all integrally formed.

A fingernail protector in accordance with the present invention is easy and inexpensive to manufacture, especially owing to the integral nature of the protector. In addition, the toggle hinge keeps the fingernail shield portion of the device in a raised or removed position while the user is busy applying a coat of fingernail enamel to the surface of the respective finger. There is no danger that the shield will close accidentally, thereby possibly damaging the smoothness of the enamel coating. Another advantage of a fingernail protector in accordance with the present invention is that the shield portion is pivoted upwardly over the finger, thereby minimizing interference of the shield with adjacent fingers and vice versa.

DETAILED DESCRIPTION

Figure 1:
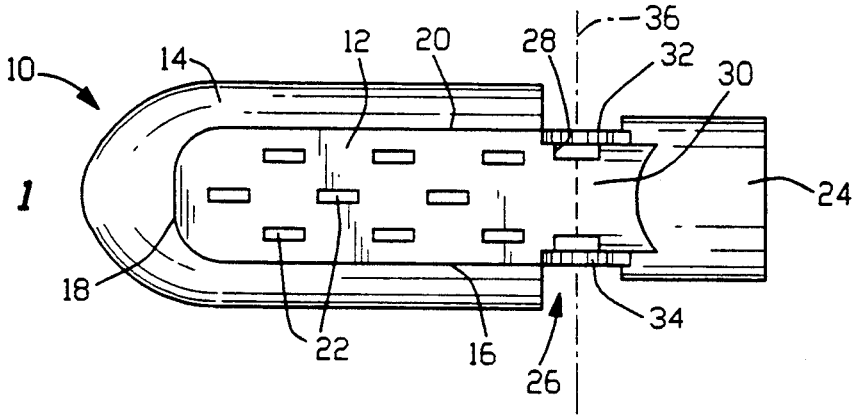
FIG. 1 is a top plan view of a fingernail protector in accordance with the present invention, showing a shield portion of the fingernail protector in a fingernail covering position.
Figure 4:
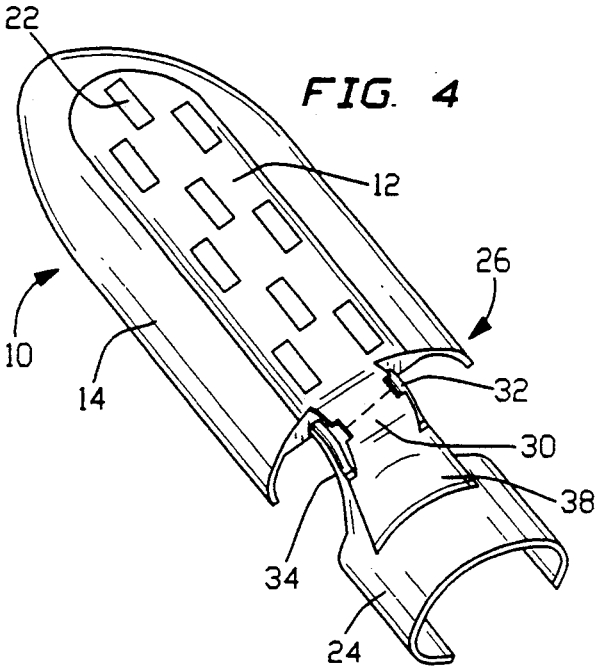
FIG. 4 is a perspective view of the fingernail protector of FIGS. 1-3.

As illustrated in the drawing figures, a fingernail protector comprises a fingernail shield 10 having a substantially planar body portion 12 and a skirt 14 integral with the body portion along three edges 16, 18, and 20 thereof. Shield 10 is provided with a plurality of apertures 22 for facilitating air circulation about a user's fingernail to accelerate an enamel drying process.

The fingernail protector further comprises a resilient slotted ring 24 for attaching or securing the protector to a person's finger.

Shield 10 is pivotably coupled by a connector portion 26 to slotted ring 24 along a fourth edge 28 of body portion 12. Connector portion 26 includes a fold-line hinge 30 and a pair of resilient link members 32 and 34 connecting shield 10 to slotted ring 24 on opposite sides of fold-line hinge 30.

Figure 5:
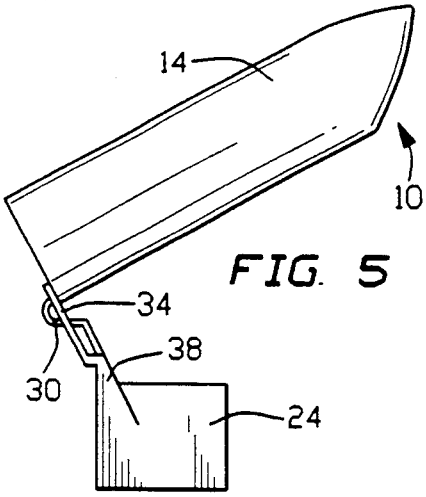
FIG. 5 is a side elevational view of the fingernail protector of FIGS. 1-4, showing the shield portion in an elevated or removed position.
Figure 2:
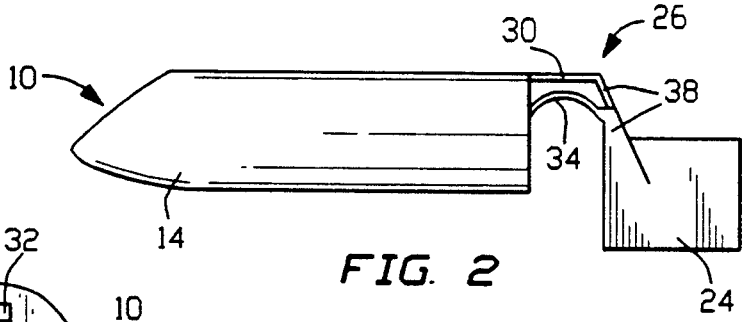
FIG. 2 is a side elevational view of the fingernail protector of FIG. 1.
Figure 3:
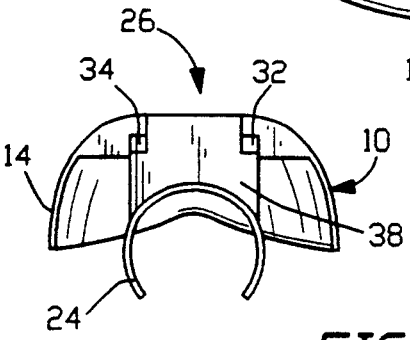
FIG. 3 is an end elevational view of the fingernail protector of FIGS. 1 and 2.

Link members 32 and 34 act as spring elements in cooperating with fold-line hinge 30 to form a toggle coupling between shield lo and ring 24. Accordingly, shield 10 is swingable between a first stable toggle position (FIGS. 1–4) in which the fingernail is covered and a second stable toggle position (FIG. 5) in which the shield is removed or raised from the fingernail to allow the application of an enamel coating to the nail. Link members 32 and 34 act to lock shield 10 in the removed position of FIG. 5 and alternately in the fingernail covering position of FIGS. 1–4.

Upon attachment of ring 24 to a person's finger, shield 10 is disposed distally of the ring in the finger covering or use position of the shield (see FIGS. 1–4). Shield 10 is swingable about a fold-line axis 36 oriented substantially transversely to the user's finger. Membrane-type fold-line hinge 30 (and additionally resilient link members 32 and 34) is connected to ring 24 via a projection 38 so that shield 10 and particularly planar body portion 12, as well as hinge 30 and concomitantly axis 36, are spaced from attachment ring 24 and a user's fingernail during use or the nail protector device. Projection 38 extends from ring 24 in an orthogonal or radial direction perpendicular to axis 36.

The fingernail protector described herein is an integral piece of polymeric material formed by injection molding. It is, therefore, easy and inexpensive to manufacture.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are preferred by way of example to facilitate comprehension of the invention and should not be construed to limit the scope thereof.

What is claimed is:

1. A fingernail protector comprising:

a fingernail shield;

attachment means for temporarily securing the protector to a user's finger; and connector means including a toggle hinge for pivotably connecting said shield to said attachment means so that said shield is disposed distally of said attachment means in a use position of said shield and so that said shield is swingable about an axis oriented substantially transversely to the user's finger, said toggle hinge including a membrane-type fold-line hinge part and a pair of arcutate resilient spring parts spaced from said fold-line hinge part on opposite sides thereof, said connector means further including spacer means for spacing said shield from said attachment means in an orthogonal direction essentially perpendicular to said axis so that said membrane-type fold-line hinge part and concomitantly said axis are spaced from a wearer's fingernail and said attachment means during use of the fingernail protector, said spacer means including a projection extending from said attachment means in said orthogonal direction, said membrane-type fold-line hinge part and said arcuate resilient spring parts being connected to said projection.

2. The fingernail protector set forth in claim 1 wherein said shield has a substantially planar body portion and a skirt integral with said body portion along three edges thereof, said shield being connected by said connector means to said attachment means along a fourth edge of said body portion.

3. The fingernail protector set forth in claim 2 wherein said shield is provided with a plurality of apertures in said body portion.

4. The fingernail protector set forth in claim 1 wherein said shield, said attachment means and said connector means are all integrally formed.

* * * * *